United States Patent [19]

Breithaupt

[11] Patent Number: 4,557,089

[45] Date of Patent: Dec. 10, 1985

[54] STRUCTURAL ELEMENT SUCH AS BUILDING FACADE AND THE LIKE

[75] Inventor: Albert Breithaupt, Cologne, Fed. Rep. of Germany

[73] Assignee: Trube & Kings KG, Fed. Rep. of Germany

[21] Appl. No.: 461,655

[22] Filed: Jan. 27, 1983

[30] Foreign Application Priority Data

Feb. 3, 1982 [DE] Fed. Rep. of Germany ..... 3203625

[51] Int. Cl.[4] ..... E04B 1/70

[52] U.S. Cl. ..... 52/235; 52/395; 52/403; 52/464; 52/317

[58] Field of Search ..... 52/235, 464, 463, 302, 52/303, 395, 403, 317

[56] References Cited

U.S. PATENT DOCUMENTS

| | | | |
|---|---|---|---|
| 3,488,906 | 1/1970 | Brooks | 52/235 X |
| 3,858,375 | 1/1975 | Silvernail | 52/235 |

FOREIGN PATENT DOCUMENTS

| | | | |
|---|---|---|---|
| 229350 | 3/1956 | Australia | 52/235 |
| 1150188 | 6/1963 | Fed. Rep. of Germany | 52/235 |
| 363142 | 7/1962 | Switzerland | 52/235 |
| 832132 | 4/1960 | United Kingdom | 52/235 |

*Primary Examiner*—Donald G. Kelly
*Assistant Examiner*—Richard E. Chilcot, Jr.
*Attorney, Agent, or Firm*—Wigman & Cohen

[57] ABSTRACT

The invention concerns the provision of structural elements for building facades and the like, which are provided for fire protection according, for example, to German Industrial Standard requirements. Accordingly, measures should be provided for self-supporting fire protection elements which prevent the spreading of fire, for example, from floor to floor, regardless of whether the fire comes from the outside or the inside. This object is achieved in that the composite connecting body (4) consists of at least one statically loadable bearing body having an aluminum core (18) which is completely or partially surrounded by fire suppressant material (9). This fire suppressant material (9) can be provided with or without a covering (10).

28 Claims, 2 Drawing Figures

STRUCTURAL ELEMENT SUCH AS BUILDING FACADE AND THE LIKE

BACKGROUND OF THE INVENTION

1. Field of the Invention

The invention relates to a structural element such as a building facade and the like.

2. Description of the Prior Art

Fire protection elements such as windows, doors, gates and shutters, in addition to supplementary top, side and bottom pieces, serve to close walls and/or structural openings in buildings and do so namely at all locations where they are required by the national and local building codes.

Since fire resistant glasses have come into existence, exterior openings are increasingly being provided with fire resistant windows at particularly endangered locations, such as where portions of the building join at right angles.

The numerous large fires in hotels, office buildings and other large buildings, and particularly the spreading thereof into the interior portions of large cities, have shown that flames spread not only from floor to floor, but also from building to building.

In this respect, buildings with facades hung or built into the front thereof, regardless of which construction, are especially dangerous to the neighborhood in case of fire, because the exterior building surfaces, which open due to the effects of the fire, magnify the size and potential effects of the fire on adjacent and opposite buildings.

Since particularly in areas of cities having numerous office buildings, entire rows of streets have buildings with facades hung or built onto the fronts thereof, thus, it would be advisable to provide buildings endangered in this manner with fire resistant facades and/or roofs, which prevent the spreading of destructive fires to other floors and buildings within the framework of the common fire classes according to, for example, German Industrial Standard 4102.

Today there are no such surrounding or partially surrounding structural elements for buildings.

SUMMARY AND OBJECTS OF THE INVENTION

The object of the invention is to create structural elements, such as building facades and the like, which fulfill the German Industrial Standard requirements for fire protection, whereby measures are provided for self-supporting fire protection elements which prevent the spreadng of fire (for example from floor to floor, etc.), regardless of whether the fire approaches from within or without.

This object is achieved by the distinguishing characteristics of the present invention.

By means of the described solution according to the invention, it is assured that the German Industrial Standard requirements for fire protection are met. In accordance therewith, bearing metal structures for large-surface facades can use the measures according to the invention in any desired combination. The bearing metal structures basically consist of a combination of two complementary rungs, tie-beams or supports, one of which is a statically loadable, heat resistant and largely non-heat-transferring connecting body, while the other is arranged on the exterior surface and fulfills a purely supplementary function, securing the filling elements. In accordance herewith, aluminum is particularly suitable as a material for bearing metal structures, which until recently was considered in the prevailing view to be unsuitable for the provided purpose. Accordingly, the advantage of the invention lies particularly in the fact that in case of fire the non-affected floors, structural elements of neighboring buildings, etc., will be protected better than has heretofore not been possible from a spreading fire.

In the examples, and also in the distinguishing elements, aluminum is usually mentioned as a suitable material. The appropriate use of other materials to a suitable extent is conceivable, for example, steel, plastic coated steel, or plastic foils. In accordance therewith, the reinforcing material can also be covered with plastic, to the extent that they are steel reinforcement materials.

BRIEF DESCRIPTION OF THE DRAWINGS

Further details of the invention will be seen from the drawings and specification, and namely shown are.

DETAILED DESCRIPTION OF THE PREFERRED EMBODIMENT

Figure 1:
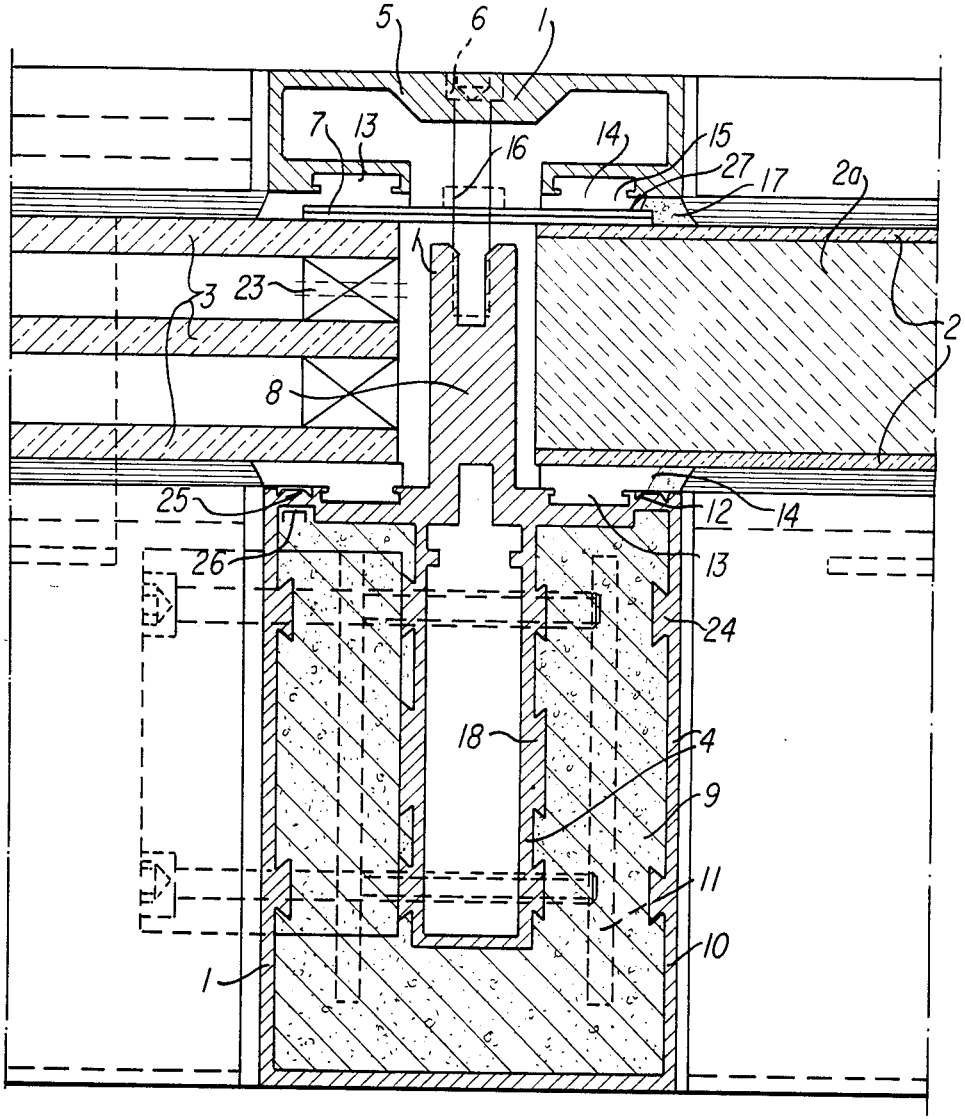
FIG. 1—a schematic arrangement of a connecting body according to the invention, whereby as a filling element, a glass disc system in the form of fire resistant glass is indicated on the left side and a fire resistant plate is indicated on the other side, and FIG. 2—a partial view of a special embodiment.

The building-covering structural element according to the invention basically consists of the supporting, complementary metallic construction 1, consisting of covering 10, aluminum core elements 8,18 and cover strip 5, whereby appropriate insulation elements and sealing strips 14 can be located therebetween.

Used as a filling element in the illustrated non-binding example is glass pane element 3, consisting of fire resistant glass of a known type. Fire resistant plates 2 are provided on the opposite side; here other fire resistant items such as panels, glass asbestos, glass wool, windows, etc. are used, as indicated by the reference *2a*.

A composite connecting body 4 according to the invention consists in the illustrated example of a metal core, here an aluminum core, whereby the core element 18 is formed as a hollow element; a solid material could also be used here. The core element 18 is surrounded at a spaced distance by the covering 10, which can also consist of aluminum. This covering is preferably selected so as to be very thin walled and includes mounting elements—here dove-tails 24—so that the introduced fire suppressant material 9 can be made to hold in place; and such mounting elements are, in accordance with the invention, also provided on the core element 18. The fire suppressant material 9 can be introduced in liquid, soft or rigid form; it then builds a protective layer for the core element 18. Reinforcements 11, such as plates of aluminum, plastic foils and the like, are advantageously reinforced with metal wire mesh and the like.

If the composite connecting body 4 is formed as shown in FIG. 1, a metallic connection is provided from the outside toward the aluminum core element 8, namely by means of connecting points 12. Actually, these points 12 are already formed as zones of lower heat conductivity, because they are shown as being very thin walled and have, in the illustrated embodiment, two cuts 25. These cuts 25 are provided in order to be able to separate the connecting points 12 after the fire suppressant material 9 solidifies. There is then no metallic connection from the covering 10 toward the core element 8.

When the connecting points 12 are reduced to, for example, the thickness of foil, in certain cases the separation of the connecting points 12 is not necessary. At these points 12 a foil or foil strips 26 could also be provided, which at first—as long as the suppressant material 9 is still doughy—still holds the suppressant material 9 and does not transfer the heat resulting from a fire from the outside to the inside.

The complementary metallic construction 1 consists in principle of the composite connecting body 4, which is connected with the cover strip 5. Fasteners such as screws 6 or other known means can be used as connecting means having the lowest possible heat-conducting cross section.

Securing plates 7, which secure the filling elements—i.e., fire resistant glass plates 2 and fire resistant glass pane elements 3—against falling inwardly or outwardly in case of a fire, are arranged between the composite connecting body 4 and the cover strip 5.

The shape of the covering 10, here shown with four corners, is not important. Any other desired, suitable cross-sectional shape corresponding to a geometrical shape is conceivable.

In accordance with the invention, recesses 13 are provided in the core element 8, which serve to receive premanufactured elastic or partially elastic sealing strips 14.

When the aluminum core elements 8,18 and the covering 10 are not made in one piece as shown, these elements, 8,18 are to be connected with known means, whereby here again it must be noted that the lowest possible heat conductivity is achieved.

Materials such as open pore glass ceramic can be used as fire suppressant material 9, as can a cellular material including silicates, aluminates or phosphate inclusions.

The cover strip 5 should, in accordance with the purpose of the invention, also be manufactured of aluminum. It also includes recesses 13, into which the sealing strip 14 is inserted.

Screw 16 holds the securing plate 7, which can also consist of numerous layers, to the aluminum core elements 8,18. Accordingly, the filling elements 2,3 are simultaneously fixed in their positions, even if the cover strip 5 should melt in case of a fire.

Figure 2:
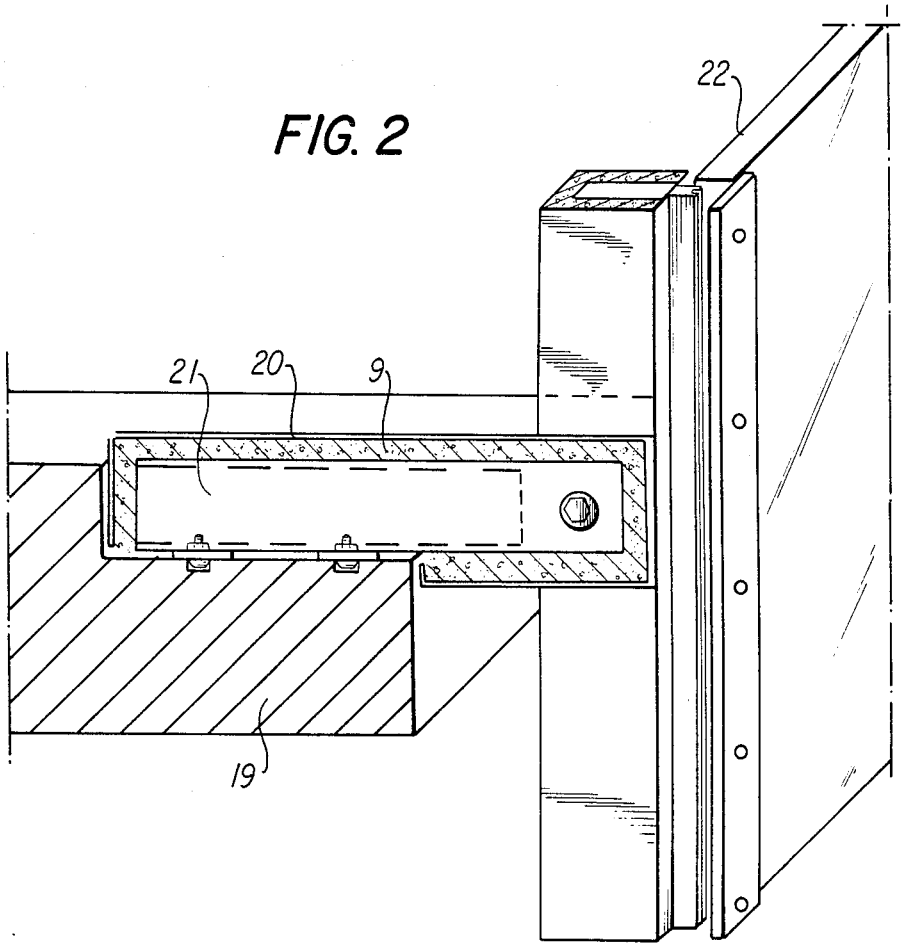

FIG. 2 shows a section of the arrangement, for example a pipe, as a statically bearing element 21. As known, it connects, for example, a facade or a glass panel 22, with a solid portion of a building, such as building 19. In the sense of the invention, this bearing element 21 in the nature of an anchor or pipe is surrounded at a distance by an insulating sheath 20 and the intermediate space between the sheath 20 and the bearing element 21, for example, is filled with fire suppressant material 9. It is understandable that in this case, too, the stated object is achieved in case of fire danger. According to FIG. 2, all anchors, anchor structures between fire protection construction and ceiling/support/concrete wall, masonry wall and steel construction can be, for example, completely or partially protected as thermal and fire protection coating safety measures.

A further suggestion according to the invention may be gathered from FIG. 1 (see right side). The sealing strip 14 here consists of at least two materials, whereby the outwardly facing element is an elastic element 17, consisting for example of soft plastic, rubber, etc. From a certain boundary layer 27 on a separating line, the material becomes less elastic, because there is stored metallic powder, particularly aluminum powder, or other known substances. With these measures according to the invention, it is possible for the first time to form a sealing strip 14 in such a manner that it fulfills two functions, namely, it is elastic on the one hand and, on the other hand, it at least hinders the breakthrough of flames. With these measures, the arrangement can also take place other than as is shown here. If necessary, a layer of the material according to a section 15 could elastically remain where it lies against the securing plate 7.

A further important concept of the invention is provided by the fact that excess pressure safety valves 23 are arranged between the insulating pane elements 3. When an inordinate amount of heat has been generated, the gas/air between the glass pane elemtns 3 expands. By means of the expansion, the pane elemtns 3 bend and come loose and then no longer meet safety requirements. In order to prevent this failure, according to the invention, an excess pressure safety valve 23 is built into every gas/air space between the pane elements 3, so that the excess pressure can escape to the outside when heat develops.

This embodiment of the present invention is considered illustrative only since other modifications will be readily discerned by those skilled in the pertinent art. In any event, the scope of the invention is intended to be covered by both the letter and the spirit of the appended claims.

PARTS LIST (Components of the Application)

1=metallic structure
2=fire protection plates
**2*a***=panels, glass asbestos, glass wool, windows, etc.
3=fire protection glass, glass disc system, insulating glass
4=composite body
5=covering strip
6=screw
7=anchoring plate (perhaps formed of many plates)
8=metallic core, particularly an aluminum core
9=suppressant material, suppressant material sheath
10=sheath (metallic or non-metallic sheath)
11=reinforcement, inclusions
12=connecting points, zones of lower heat conductivity
13=recess
14=sealing insulating strip, sealing strip
15=non- or slightly elastically element of the insulating strip 14 (metallic stores in, for example, rubber, plastic, etc.)
16=screw
17=elastic portion of the insulating strip 14
18=bearing body, aluminum core, core of steel or plastic-coated steel
19=portion of a building (concrete wall, masonry wall, steel construction, etc.)
20=insulating sheath wrapping
21=statically bearing portion of the anchor, pipe, etc., for example
22=glass areas
23=excess pressure valve 24=mounting elements
25=cuts
26=foil, foil strips
27=boundary layer

APPENDIX:

Approximate Composition of the glass-type suppressant materials for PYRAL shaped elements

| Material | Primary Components | Contents less than 10 (Mass %) |
|---|---|---|
| Alkali silicate | 72.5 $SiO_2$ 13.0 $Na_2O$ | $Al_2O_3$, $K_2O$, CaO, MgO, $SO_3$ |
| Alumosilicate, aluminate | 52.0 $SiO_2$ 22.0 $Al_2O_3$ | $B_2O_3$, CaO, MgO, BaO, $P_2O_5$ |
| Ceramic Glass | 67.0 $SiO_2$ 23.0 $Al_2O_3$ | $TiO_2$, $ZrO_2$, $Li_2O$ |
| Phosphate | 58.0 $P_2O_5$ 20.0 $Na_2O$ | $Al_2O_3$, $K_2O$, CaO, ZnO, Bao, F. |

The composition of these materials refers to the molten condition and may vary within wide limits.

I claim:

1. A fire protection element for holding filling elements for building facades, comprising:
   - a composite connection body having at least one statically loadable bearing body;
   - a fire suppressant material surrounding the bearing body;
   - a covering around said fire suppressant material;
   - the bearing body being a hollow element with an aluminum core;
   - the aluminum core and the covering being separated from each other by the fire suppressant material;
   - further comprising a cover strip mounted so as to hold filling element between the cover strip and the bearing body, the cover strip and the composite connection body including recesses;
   - sealing strips disposed within the recesses to provide a seal relative to the filling elements.

2. Structural element according to claim 1, characterized in that the covering consists of a thin walled metallic material.

3. Structural element according to claim 2, characterized in that the covering has a round, multiple-cornered, cross-sectional shape.

4. Structural element according to claim 2, characterized in that the covering is at least partially open in one direction.

5. Structural element according to claim 2, characterized in that an open side of the covering lies against fire resistant glass with an insulation material arranged therebetween.

6. Structural element according to claim 1, characterized in that a non-metallic, connection exists between the bearing body and the covering.

7. Structural element according to claim 1, characterized in that, with a metallic connection, zones of lower heat conductivity exist between the bearing body and the covering.

8. Structural element, according to claim 1, characterized in that the fire suppressant material comprises an open-pored glass ceramic which contains hollow ceramic balls having a binding agent.

9. Structural element according to claim 1, characterized in that the fire suppressant material comprises fibrous aluminum silicates with binding agents.

10. Structural element according to claim 1, characterized in that the fire suppressant material is arranged in solid form in the covering in the shape of a plate.

11. Structural element according to claim 1, characterized in that metallic materials are provided as reinforcement in the fire suppressant material to increase the static strength thereof.

12. Structural element according to claim 1, characterized in that at least one securing plate is arranged between the composite connecting body and the cover strip which plate is connected to the composite connecting body by screws.

13. Structural element according to claim 12, characterized in that the securing plate is formed in at least one layer comprising stacked plates which are connected with each other.

14. Structural element according to claim 12, characterized in that the securing plate consists of a fire-resistant material.

15. Structural element according to claim 1, characterized in that the sealing strips comprise elastic materials which correspond to the recesses of the cover strip.

16. Structural element according to claim 1, characterized in that the sealing strips comprise flame resistant elastic materials having heat resistant properties.

17. Structural element according to claim 1, characterized in that the sealing strips comprise a combination of elastic, flame-resistant material and a nonelastic non-combustible material.

18. Structural element according to claim 17, characterized in that the nonelastic non-combustible material of the sealing strips is a metallic material.

19. Structural element according to claim 1, characterized in that the covering has a wall thickness of less than one millimeter.

20. Structural element according to claim 1, characterized in that the covering comprises a shaped aluminum foil provided on at least one side with a heat reflecting material layer.

21. Structural element according to claim 1, characterized in that statically loaded elements are connected to the bearing body.

22. Structural element according to claim 1, characterized in that insulation glass is associated with an excess pressure valve through which the sealing strips are introduced.

23. Structural element according to claim 2, wherein a metallic connection is provided frm the outside toward the aluminum core by separable connection points.

24. Structural element according to claim 23, characterized by cuts in the separable connection points in the area of the aluminum core elements in the direction of the covering, preferably provided against the covering.

25. Structural element particularly according to claim 1, characterized by recesses in the bearing body and in a cover strip therefor.

26. Structural element according to claim 25, characterized in that the recesses are dove-tail shaped.

27. A fire protection element, comprising:
   - a supporting metal element having a gripping area for gripping a fire protection filler element such as a fire protective plate;

a fire resistant material surrounding the metal element up to the gripping area of the filler element;

a metal cover encompassing the fire resistant material;

the supporting metal element, the fire resistant material and the cover being joined to each other to form a compound element;

the supporting metal element and the cover being made of aluminum and being separated from each other in such a manner that heat transfer between them is prevented; and an exterior cover strip being connected with the supporting metal element by attaching means to grip the filler element between said cover strip and the supporting metal element.

28. Fire protection element according to claim 27, wherein at least one securing plate is secured between the cover strip and the filler element, said securing plate being arranged so as to abut the filler element.

* * * * *

UNITED STATES PATENT AND TRADEMARK OFFICE

CERTIFICATE OF CORRECTION

PATENT NO. : 4,557,089

DATED : December 10, 1985

INVENTOR(S) : ALBERT BREITHAUPT

It is certified that error appears in the above—identified patent and that said Letters Patent is hereby corrected as shown below:

Column 5, line 32 change "element" to --elements--.

Column 6, line 53 change "frm" to --from--.

Signed and Sealed this

*Third* Day of *June 1986*

[SEAL]

*Attest:*

DONALD J. QUIGG

*Attesting Officer*

*Commissioner of Patents and Trademarks*